United States Patent [19]

Lehtinen

[11] 4,229,250

[45] Oct. 21, 1980

[54] METHOD OF IMPROVING PROPERTIES OF MECHANICAL PAPER PULP WITHOUT CHEMICAL REACTION THEREWITH

[75] Inventor: Antti Lehtinen, Jyvaskyla, Finland

[73] Assignee: Valmet Oy, Finland

[21] Appl. No.: 16,146

[22] Filed: Feb. 28, 1979

[51] Int. Cl.[2] ..... D21B 1/16

[52] U.S. Cl. ..... 162/23; 162/24; 162/26; 162/71; 162/183

[58] Field of Search ..... 162/23, 24, 25, 26, 162/28, 71, 183

[56] References Cited

U.S. PATENT DOCUMENTS 3,388,037 6/1968 Asplund et al. ..... 162/28

FOREIGN PATENT DOCUMENTS 2816566 10/1978 Fed. Rep. of Germany ..... 162/28

441380 5/1975 U.S.S.R. ..... 162/24

OTHER PUBLICATIONS

Casey, J. P., "Pulp & Paper", vol. II, Sec. Ed. Interscience Pub., N.Y., N.Y., 1960, pp. 994–995.

*Primary Examiner*—William F. Smith

*Attorney, Agent, or Firm*—Steinberg & Blake

[57] ABSTRACT

Properties of mechanical paper pulp which is produced by grinding or otherwise frictionally acting on natural fibrous raw material containing plasticizable constituents which become heated to a temperature sufficiently high to soften the plasticizable constituents thereof are improved by the addition of paper filler material which is chemically inert to the pulp at a time which results in the filler being in contact therewith while the plasticizable constituents are plasticized and thus softened and sticky. This causes the filler, without chemical reaction, to adhere to the plasticized constituents and thus to the fibers of the pulp to result in improved properties of a totally mechanical pulp. The properties which are improved include the optical and printing properties of the paper made from the pulp.

10 Claims, 3 Drawing Figures

METHOD OF IMPROVING PROPERTIES OF MECHANICAL PAPER PULP WITHOUT CHEMICAL REACTION THEREWITH

BACKGROUND OF THE INVENTION

The manufacture of paper pulp stock from wood by defibrating the wood raw material into fibers suitable for paper making can take place either chemically as a pulp cooking process or by subjecting the deciduous material to mechanical defibrating treatment.

There are two basic types of methods for the mechanical defibrating of wood. The oldest method is the grinding process in which wet logs of suitable length are pressed against the coarse surface of a rotating cylindrical grinding stone. Water in proper amount is also directed onto the grinding surface. The water is necessary because the grinding of totally dry wood leads to the production of useless wood flour. This process results in practically all of the wood material being converted into an aqueous fiber slurry, with the exception of splinters and slivers. This type of fiber pulp stock is generally used as raw material for newsprint.

A more modern mechanical pulp manufacturing method makes use of chipped wood, i.e. wood in the form of wet chips, which are defibrated for example between two disc-like grinding elements which rotate relative to each other and which have a suitable surface structure. This method also results in a pulp slurry which after screening is suitable for paper making.

As is well known, wood contains 20–30 percent of lignin which is an aromatic substance having a large molecular size. Lignin resembles glue to some degree and it acts to bond the wood fibers together. In pulp cooking or other chemical reactions on the pulp, the lignin is mainly dissolved. However, in mechanical defibration the lignin remains on the fibers.

Thus, it is a characteristic of mechanical pulp manufacturing methods that all of the constituents of the wood, that is the cellulose fibers and the lignin bonding the fibers together are present in the produced pulp fiber stock. Moreover, these mechanical pulp manufacturing methods produce an appreciable amount of heat during the defibration process because the mechanical energy is converted to heat and this results in the temperature of the pulp rising to a level which is sufficient to make the lignin soft and sticky.

In recent years a new type or grade of mechanical pulp, so called thermomechanical pulp has gained wide acceptance. This pulp is made from chips in a disc type refiner. In this manufacturing process heat is added in addition to that which is generated by the friction on the chips during the defibration process. Due to the increased temperature in the production of thermomechanical pulp the lignin is softened more thoroughly than in the conventional mechanical pulp processes. This means that the fibers are separated from each other quite easily and in comparatively intact condition so that the fibers are long and pliant. As a result, the quality of the thermomechanical pulp, from the standpoint of paper making, is in many respects higher than that of other mechanical pulps. Thus, in the manufacture of newsprint it is possible to produce paper entirely from thermomechanical pulp, whereas in the case of the use of conventional mechanical pulps (e.g. groundwood) for the production of newsprint it is necessary to add a considerable amount, up to 25%, of chemical pulp or cellulose in order to obtain the required strength for the paper.

It is in general necessary to improve the optical and printing properties of pulps in order to be able to use the same for newsprint and other purposes. Mineral fillers are used in particular to improve the printing properties and opacity of the paper. The introduction of the filler material may take place in one of two different ways, either by mixing the filler with the paper stock or by coating the paper web. In the mixing method the filler is added as a suspension into the pulp stock slurry before the stock enters the paper machine. This is accomplished by introducing the filler as an aqueous suspension of 30–40% solids into the mixing chest following the high consistency stock chest. However, the problem with the use of fillers has always been that they are very poorly retained by the fibers. While it is possible to mix the filler material in the pulp stock slurry so that a homogenous suspension of filler particles and fibers with the water is obtained, when the suspension is fed onto the paper machine wire, where it is dewatered and a continuous web formed from the fibers, a considerable portion of the filler material is removed with the water and the remaining portion of the filler material has a tendency to concentrate on only one surface layer of the web, which results in so called one-sidedness. The quantity of filler added to the paper stock may vary, depending upon paper grade, from 2 to 40% of the weight of the paper produced. The most common filler contents are 5–20%. Talc, clay (kaolin), chalk and other equivalent substances are usually used as fillers. In recent times there has been increased use of high quality fillers such as titanium oxide and zinc sulphide pigments for improvement in the opacity of the paper. Generally speaking the fillers are used for improving the opacity and brightness of the paper and for increasing its receptivity to printing ink, as well as for improving the smoothness and finish of the paper.

As indicated above, while the use of fillers is generally well known, the problem has remained, particularly in the production of mechanical pulp, of retention of the filler by the fibers.

U.S. Pat. No. 3,388,037 describes the production of mechanical pulp wherein the pulp is chemically acted upon, for example by sulfite solution and by sodium peroxide or hydrogen peroxide or hypochlorite. Some fillers may be added along with the chemical solutions in which case, in addition to the whitening effect of the chemical solution there is a further chemical reaction between the fibers and the filler material. In addition to the expense of chemical processing this process suffers from the disadvantage of the loss of newsprint yield because the chemical action consumes a portion of the wood, as well as of the lignin or the like which binds the wood fibers together.

SUMMARY OF THE INVENTION

Generally speaking, in accordance with the present invention, fillers are added to and mixed with the mechanical pulp stock during the production thereof at such time that the filler material is in contact with the pulp fibers while the plasticizable constituents thereof are in softened and sticky material and remain in contact therewith for a sufficient time during which the plasticizable constituents are in such condition so that the filler materials adheres to the fibers to a much greater degree than with known methods, and has the effect of improving the properties of the resulting mechanical pulp for paper making purposes without chemical reaction. Thus, for example, the fillers can be added to the raw material of the pulp before the same is frictionally acted upon in the mechanical defibration process so that is remains in contact therewith during the frictional heating when the plasticizable constituents become softened and sticky and thus adheres thereto. However, it is preferred to add the fillers during the mechanical defibration or very shortly thereafter while the plasticizable constituents of the pulp are still in softened and sticky condition.

Accordingly, it is a primary object of the present invention to provide a method whereby considerable quantities of filler material can be made to become fixed to the fibers of mechanical pulp without chemical reaction therewith.

It is another object of the present invention to provide a method which can result in increase in the brightness and opacity of paper made from mechanical pulp. It is yet another object of the present invention to reduce the blackening tendency of paper made from mechanical pulp when this paper is calendered at moisture contents higher than 10–11%.

It is still another object of the present invention to reduce the one-sidedness or assymmetry in the structure of paper made from pulp and the linting tendency of paper which is loaded with fillers.

A further object of the present invention is to improve the possibilities for the use of filler materials which are advantageous for the paper quality but which due to their relatively poor retention to fibers makes their use difficult in paper making.

Other objects and advantages of the present invention will be apparent from a further reading of the specification and of the appended claims.

With the above and other objects in view, the present invention mainly comprises in the production of mechanical paper pulp from natural vegetable fibers for material, particularly wood, by frictionally acting upon fibrous raw material containing plasticizable constituents which during the process are heated to a temperature sufficiently high to plasticize such constituents and soften and render the same sticky while at least partially separating the fibers from each other, which comprises adding at least one paper filler material which is chemically non-reactive with the fibrous pulp through the same at such time that when the plasticizable constituents thereof are in softened and sticky condition the filler is in contact therewith and remains in contact therewith for a sufficient time to adhere to the plasticizable constituents and thus to the fibers of the pulp, thus resulting in improvement of the properties of the mechanical pulp.

It is thus clear that in accordance with the present invention advantage is taken of the elevated temperature in the defibrating process and in the presence of lignin or an equivalent plasticizable substance on the defibrated fibers to improve the properties of the mechanical pulp without chemical reaction therewith. The fillers which are utilized primarily are used to improve the optical properties such as opacity and brightness and to increase the receptivity of the paper to printing ink, as well as to improve the smoothness and finish of the paper.

This is accomplished in accordance with the present invention by increased retention of the filler material onto the fibers in an inexpensive manner without using chemical reactions and is accomplished by making use of the natural lignin or the like in the fiber and the high temperature obtained during the mechanical defibration to cause the filler material to stick to the lignin and become fixed on the surface.

Although lignin is mainly mentioned as the plasticizable constituent of wood or the like, the same becoming plasticized at increased temperature for example 100°–170° C., it must be borne in mind that certain paper stocks may contain other plasticizable constituents such as hemicellulose which are plasticized in the same manner as lignin. For instance, hardwood pulps and paper stock made of bagasse contain large quantities of hemicellulose and these materials can be subjected to the process of the invention in the same manner as woods which contain lignin.

It should be understood that any filler material which is commonly used in paper stocks and which is not chemically reactive with the fibrous pulp may be utilized as filler for the purposes of the present invention, and although specific examples of filler materials are mentioned, it is to be understood that the invention is not limited thereto. Thus, for example, among the more commonly used fillers or loading materials for the manufacture of paper, all of which may be used for the purposes of the present invention, are kaolin, talc, calcined gypsum, chalk, precipitated calcium carbonate, barium sulfate in cylindrical granular form known as blanc fixe, barium sulfate in arthro-rhombic form known as baryte, silica, titanium dioxide (anatase or rutile), zinc sulfide, etc.

Also, the amount of filler which is added according to the present invention can vary depending upon the final use for which the paper is intended. The advantages obtained according to the present invention that there is less waste of filler material because it almost totally adheres to the fibers in the course of the process.

In general, the amount of filler, analyzed in terms of ash content in the finished paper, may vary between about 2–40% by weight, most common amounts varying between 5–20% by weight of the paper. As indicated above, the amount is dependent upon the intended use of the final product.

The filler material, as previously mentioned, may be introduced into the defibrating system while the fillers are suspended in water to form a filler slurry, i.e. an aqueous suspension which may have about 30–40% of solids. On the other hand, the consistency or the solid content with regard to fibers of the pulp varies greatly depending upon the defibrating method.

If defibrating is performed by means of a grinding stone, the resulting pulp consistency may be in the range of about 1–2% or even higher. Due to the great dilution (50–100 times) of the pulp slurry and the high consistency (30–40%) of the filler slurry the latter does not remarkably affect the resulting filler-mixed pulp stock consistency.

On the other hand, in the manufacturing of mechanical pulp from chips, particularly thermomechanical pulp, the most suitable solids content (of fibers) of the resulting pulp is approximately 20–25%. Maximum filler suspensions flow if all fillers are fed in the defibrating state may represent 20% of the pulp slurry flow corresponding to about 8% filler solids in the pulp slurry. Excessive amount of fillers means excessive dilution of the stock which could possibly disturb the defibration process.

Consequently, in some cases it may be advantageous to introduce only a portion, for example one half of the total filler amount, to the stock during the defibrating process proper, and another portion at a later stage. Addition of all the filler material simultaneously during defibration of the stock resulting in very firm adhesion affects the pulp quality in a manner which may not always be desired and it is thus possible to control the quality of the final pulp by varying the times of addition of the filler material. Thus, divided addition may be preferred in certain instances.

It is also possible according to the present invention to use more than one kind of filler with one being introduced in the system in the defibrating stage while the other filler may be introduced at another stage.

BRIEF DESCRIPTION OF DRAWINGS

For a fuller understanding of the invention, reference is had to the following description taken in connection with the accompanying drawings, in which.

DESCRIPTION OF PREFERRED EMBODIMENTS

Figure 1:
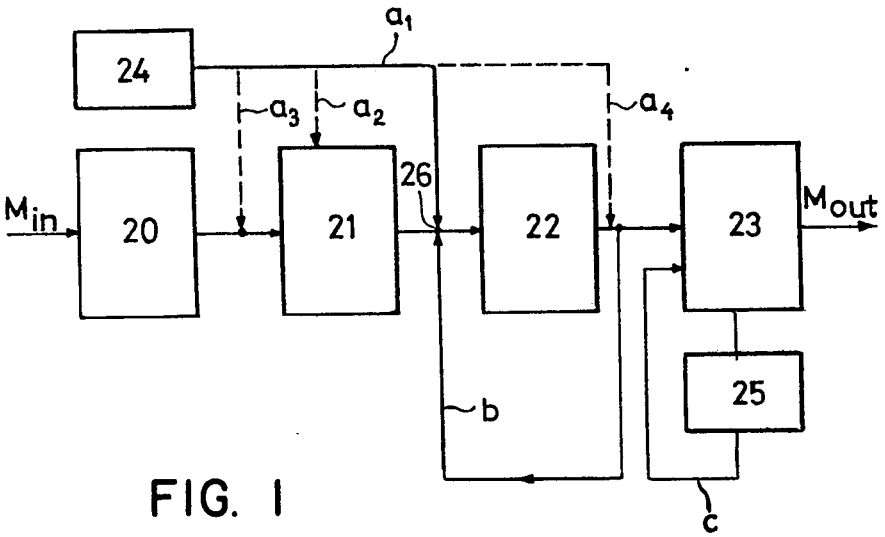
FIG. 1 constitutes a block diagram illustrating the method of the present invention particularly with respect to the manufacture of thermomechanical pulp in two defibrating stages.
Figure 2:
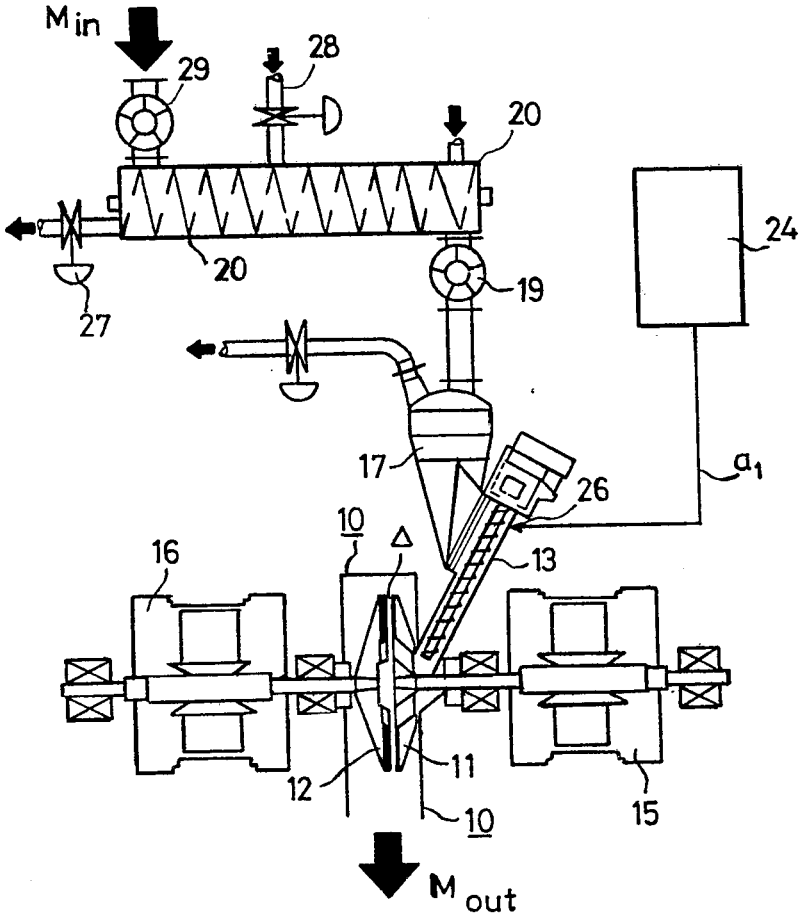
FIG. 2 diagrammetically illustrates an apparatus for carrying out the process of the FIG. 1.

Referring more particularly to the figures, in both FIGS. 1 and 2, the symbol $M_{in}$ refers to the entry of the raw material to be defibrated, and $M_{out}$ refers to the exit of the pulp.

In FIG. 2 block 20 represents the stage of preheating of the raw material e.g. wood chips, while block 21 represents the first defibrating stage and block 22 represents the second defibrating stage. The pulp from the second defibrating stage 22 is conducted to the screening and cleaning stage 23. The reject from the screening stage 23 is conducted to the reject refining stage 25 from which is is returned through conduit c to the screening and cleaning stage 23. After the second defibrating stage 22 proper a part of the pulp is returned through conduit b to the input side of the second defibrating stage 22.

According to the present invention, the filler material coming from block 24 can be introduced to the process through one or more of the conduits $a_1$, $a_2$, $a_3$ and $a_4$.

According to the preferred embodiment of the present invention, the fillers are introduced into the process at 26 between the first defibrating stage 21 and the second defibrating stage 22 through conduit $a_1$. Conduits $a_2$ and $a_3$ represented by the dotted lines illustrate embodiments of the invention according to which the filler material may in part or in whole be introduced through conduit $a_2$ directly into the first defibrating machine 21 or at its input side through conduit $a_3$. According to still another embodiment of the invention, as discussed above, the fillers may also be introduced into the process immediately after the defibrating stages 21 and 22, for example through conduit $a_4$. This alternative implies that the plasticizable constituent of the pulp must be in softened and sticky condition at the time of the addition of the filler through $a_4$.

The apparatus and mtehod of producing mechanical pulp, particularly thermomechanical pulp, of improved properties according to the present invention is illustrated in greater detail in connection with FIG. 2.

As shown in FIG. 2 a disc refiner 10 is used in the process as the defibrating machine. The refiner 10 comprises two opposed, refining or grinding discs 11 and 12 which are rotated in mutually opposite directions driven by electric motors 15 and 16, respectively. The raw material in the form of wet wood chips or sawdust particles is introduced into the refiner by means of the screw conveyor 13. The selected filler material, for example, talc or clay in an amount corresponding to the desired filler content in the paper to be produced from the pulp is introduced into the screw conveyor 13 at 26, the filler being supplied from tank 24 through conduit $a_1$.

As shown in FIG. 2, the raw material for the pulp, such as wood chips, is fed into the preheater 20 through rotary valve 29. In the preheater 20 the chips are heated to a temperature of about 100°–130° C. The preheater 20 includes a screw conveyor and the preheated wood chips leave the preheater 20 through the rotary valve 19 and are subsequently conducted through the steam separator 17 to the screw conveyor 13 by which the preheated chips are fed into the refiner 10. The screw conveyor 13 is so arranged that the steam from the refiner can be conducted in countercurrent with respect to the direction of movement of the chips.

Fresh steam is introduced into the process as required through the control valve 28 and the pressure in the preheater 20 is controlled by means of control valve 27. The pressure in steam separator 17 is controlled by a similar valve.

As is clear from FIG. 2, the wood chips and/or the sawdust particles are subjected to powerful mechanical treatment in the gap Δ between the refining discs 11 and 12 which rotate in opposite directions. Defibration of chips takes place partly by their contact with the rapidly rotating refining discs, and partly as a result of their mutual contact with each other, the friction resulting therefrom causing heating of the material under treatment. This temperature rise causes further softening and plasticizing of the lignin or other equivalent constituent of the raw material.

The fillers are admixed with the fibers in the refiner 10 and adhere to the softened lignin on the surface of the fibers.

Figure 3:
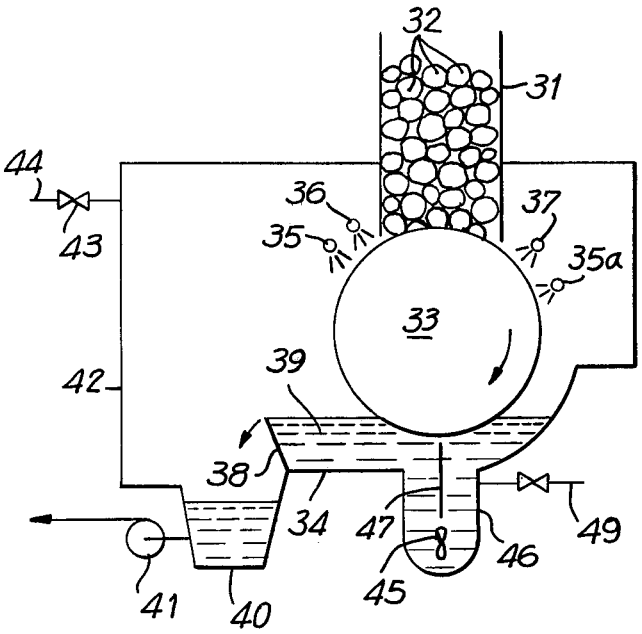
FIG. 3 diagrammetically illustrates an embodiment of the invention as applied to a defibrating process utilizing a conventional stone grinding machine.

The grinding machine shown in FIG. 3 includes a magazine 31 for the wood or logs 32 to be ground, a grinding stone 33 which rotates in the direction shown by the arrow and pulp pit 34 under the stone. By means of known devices, for instance by means of a hydraulically loaded plunger (not shown), logs 32 are pressed against the surface of the grinding stone. Water required for the grinding process is led to the surface of the stone through a shower pipe 35.

The pulp produced in the process is gathered in form of fiber-water suspension 39 in the pit 34 under the stone and flows over the overflow dam 38 to a trough 40, from which the pump 41 feeds the stock to the screening apparatus (not shown) to separate shives etc. and from there to the paper making process. The grinding stone and the stock pit are enclosed in an air tight chamber 42, where, if required, overpressure may be produced and maintained, for instance by means of compressed air fed through a pipe 44 equipped with a valve 43.

The lower portion of the chamber 42 is provided with a compartment 46 equipped with a mixer 45 in the stock pit 34, which is equipped with a partial dividing wall 47, which guides the pulp arriving continuously into the pit to flow through the compartment towards the overflow dam. The apparatus also includes a shower pipe 36, through which the filler slurry is introduced onto the surface of the grinding stone as a suspension with about 30–40% solid content. Another shower pipe 37 is arranged to feed filler material to be mixed with the pulp on the surface of the stone. The feeding of filler material can take place through either only one of the shower pipes, or both, depending on circumstances. There is connected to the pit 34 a steam pipe 49 equipped with a valve 48 to heat the pulp 39 in case increased temperature in the process is needed. The purpose of the mixer 45 is to maintain the flow of the pulp through the compartment 46 on the one hand and on the other hand to create an efficient mixing of the filler suspension with the stock.

The energy input through the shaft of the grinding stone is converted to heat during the grinding process and the temperature of the pulp produced may rise to a considerable level (100°–130°) similarly as in a process using a disc refiner. This results in the lignin or the like present in fibers becoming soft and sticky.

The pulp stock manufactured by grinding must be diluted to a consistency which permits further pumping of the pulp. Introducing the dilution water, which may take place through a hower pipe 35*a*, rapidly lower the temperature of the pulp suspension well below 100° C.

When it is desired to utilize the ability of the lignin-containing fibers to bind filler material on their surface at high tempaeratures, introduction of fillers must be carried out in connection with the grinding process or immediately thereafter. The filler suspension can be led onto the bare surface of the stone before the grinding zone. However, if this upsets the grinding process, it is possible to accomplish the filler addition immediately after the grinding zone on the grinding stone surface which is covered by the pulp.

For securing the sticking of the filler particles on the fibers, dwell time of the pulp in the grinder pit must be prolonged, which is achieved by increasing the pit volume with an additional compartment. The same purpose i.e. securing the filler fixing, is served by a mixer placed in said compartment which also provides the possibility of pulp heating by means of steam.

As is well known, production of high quality groundwood implies that the logs to be ground are wet and that during the grinding process sufficient water is present. The vast amount of heat generated in the process and the rise of the temperature to over 100° C. may cause a rapid evaporation of the water and drying of the wood material at the grinding zone. In order to prevent this the grinding process may be carried out in a pressure tight chamber in which the overpressure is maintained e.g. by means of compressed air. Overpressure may also be accomplished by the steam supply which is used for heating the pulp in the pit below the grinding stone.

As indicated above, all filler materials commonly used in the paper making may be used for the purposes of the present invention. One of the most suitable of such fillers is talc which in addition to its use in improving the optical and printing properties of the paper has been found particularly effective as an aid against so called pitch troubles which may appear when mechanical pulp is manufactured from certain raw materials e.g. pinewood.

The amounts of talc filler required for pitch control are slight, about 1–2% and this amount can be added into the system in or prior to the first defibrating stage, whereas ordinary usage for improving paper properties amounts to 5–10% depending on the paper or board grade produced, the latter amount being fed to the system in the second defibrating stage or, after the defibrating has been completed.

As indicated above, the plasticizable constituent of wood is mainly lignin and correspondingly reference is made generally to lignin as being this substance which undergoes softening and plasticizing due to the rise in temperature during the defibration process. However, it must be noted that certain paper pulps are not of woody origin or contain other constituents than lignin, which are plasticized in an equivalent manner as lignin, and from the standpoint of the present invention any such plasticizable constituent of the wood is affected in the same manner by the process of the invention, and the filler materials can be made to adhere thereto in accordance with this invention.

In general, the method of the present invention may be applied in all cases where mechanical pulps are produced and used particularly for such pulp grades in which fillers have already conventionally been used, though not introduced in the manner of the present invention. This includes the use thereof for photogravure and offset printing paper. In addition, the process of the present invention is suitable for the production of mechanical pulp for paper grades in which fillers have not hitherto been used but in which it is now possible to use fillers due to the particular advantages of the method of the present invention. Such applications include, for example, newsprint papers, particularly when it is desired to reduce the base weight of the paper which is of considerable importance at this time. This becomes possible with the method of the present invention due to the improved opacity of the produced paper.

While the invention has been illustrated in particular with respect to specific methods of production of mechanical pulp from woody raw material, it is apparent that variations and modifications as regards the raw material as well as the filler utilized and the treatment thereof can be made in accordance with the invention.

What is claimed is:

1. In the production of mechanical paper pulp from natural vegetable fibrous raw material such as wood by frictionally acting upon a natural vegetable fibrous raw material containing plasticizable constituents to at least partially separate the fibers thereof from each other while heating the plasticizable constituents thereof to a temperature sufficiently high to plasticize the same rendering the plasticizable constituents soft and sticky, the method of improving the quality and properties of pulp produced therefrom which comprises adding at least one paper filler material which is not chemically reactive with the pulp when added and at such time that it comes into contact with the plasticizable constituents of the pulp while the same are in softened and sticky condition so that the filler material adheres to but does not chemically react with the fibers of the pulp to result in improvement of the properties of the pulp.

2. In the method of claim 1 wherein said fibrous raw material is acted upon frictionally by a defibrating action and wherein said filler material is added during the defibrating of the raw material.

3. In the method of claim 1 and wherein the fibrous raw material is acted upon frictionally in a two stage defibrating operation and wherein the filler material is added to the pulp between the two defibrating stages.

4. In the method of claim 1 wherein said fibrous raw material is acted upon frictionally by defibrating action and wherein said filler material is added to the fibrous raw material before the mechanical defibrating action.

5. In the method of claim 1 wherein the fibrous raw material is acted upon frictionally by a defibrating action and wherein the filler material is added to the produced mechanical paper pulp after its defibration but while it is still sufficiently hot after the mechanical defibration action so that the plasticizable constituents of the fibers are still in softened and sticky condition.

6. In the method of claim 1 wherein the defibration is effected under pressure.

7. In the method of claim 6 wherein the increased pressure is effected by introduction of gas.

8. In the method of claim 6 and wherein the increased pressure is accomplished by the introduction of steam to the pulp.

9. In the method of claim 1 wherein said filler is selected from the group consisting of kaolin, talc, gypsum, chalk, calcium carbonate, barium sulfate, silica, titanium dioxide and zinc sulfide.

10. In the method of claim 1, wherein said filler is talc.

* * * * *